US011735377B2

(12) United States Patent
Fleureau et al.

(10) Patent No.: US 11,735,377 B2
(45) Date of Patent: Aug. 22, 2023

(54) PROTECTION DEVICE FOR AN ELECTRICAL CIRCUIT, ELECTRICAL CIRCUIT EQUIPPED WITH SUCH A DEVICE AND METHOD FOR PROTECTING SUCH AN ELECTRICAL CIRCUIT

(71) Applicant: MERSEN France SB SAS, Saint-Bonnet-de-Mure (FR)

(72) Inventors: Patrice Fleureau, Le Taillan Medoc (FR); Pierric Gueguen, Lyons (FR); Jean-François Oeuvrard, Lyons (FR)

(73) Assignee: MERSEN FRANCE SB SAS, Saint-Bonnet-de-Mure (FR)

( * ) Notice: Subject to any disclaimer, the term of this patent is extended or adjusted under 35 U.S.C. 154(b) by 0 days.

(21) Appl. No.: 17/297,820

(22) PCT Filed: Nov. 27, 2019

(86) PCT No.: PCT/EP2019/082686
§ 371 (c)(1),
(2) Date: May 27, 2021

(87) PCT Pub. No.: WO2020/109364
PCT Pub. Date: Jun. 4, 2020

(65) Prior Publication Data

US 2022/0013308 A1 Jan. 13, 2022

(30) Foreign Application Priority Data

Nov. 28, 2018 (FR) ..... 1872011

(51) Int. Cl.
*H01H 85/02* (2006.01)
*H01H 9/10* (2006.01)
*H01H 85/143* (2006.01)

(52) U.S. Cl.
CPC ..... *H01H 9/106* (2013.01); *H01H 85/0241* (2013.01); *H01H 85/143* (2013.01)

(58) Field of Classification Search
CPC ..... H01H 9/106; H01H 37/76; H01H 37/761; H01H 85/0241; H01H 85/143; H02H 3/085
See application file for complete search history.

(56) References Cited

U.S. PATENT DOCUMENTS 4,920,446 A 4/1990 Pflanz
7,875,997 B2 * 1/2011 George ..... H01H 9/106 307/117

(Continued)

FOREIGN PATENT DOCUMENTS

FR 3063570 A1 9/2018
WO 2017042321 A1 3/2017

OTHER PUBLICATIONS

Translation of WO2017042321A1. (Year: 2017).*

(Continued)

*Primary Examiner* — Jacob R Crum
(74) *Attorney, Agent, or Firm* — Pearne & Gordon LLP

(57) ABSTRACT

A protection device for an electrical circuit comprising at least one circuit breaker comprising a control zone, suitable for receiving a tripping signal (S), and a power zone for the passage of electric current. The device also comprises a control circuit configured to produce and transmit the tripping signal to the control zone. The device further comprises a fuse connected in series between the first conductor and the circuit breaker and capable of supplying a supply voltage (V) to the control circuit, the control circuit being connected between the fuse and the control zone.

10 Claims, 8 Drawing Sheets

(56) References Cited

U.S. PATENT DOCUMENTS

| | | | | |
|---|---|---|---|---|
| 10,529,521 | B2 | 1/2020 | De Palma et al. | |
| 2011/0298576 | A1* | 12/2011 | Baujan | H01H 71/122 337/5 |
| 2013/0255463 | A1* | 10/2013 | Ukon | H01H 39/006 83/639.1 |
| 2016/0372291 | A1* | 12/2016 | Darr | H01H 9/282 |
| 2017/0076900 | A1* | 3/2017 | Iwai | H01H 37/34 |
| 2017/0330715 | A1* | 11/2017 | von zur Muehlen | H01H 9/106 |
| 2018/0287365 | A1* | 10/2018 | Djelassi-Tscheck | H02H 3/046 |

OTHER PUBLICATIONS

Translation of FR3063570A1. (Year: 2017).*
Search Report for International Application No. PCT/EP2019/082686 dated Jan. 10, 2020.
Search Report for French Application No. 1872011 dated Oct. 17, 2019.

* cited by examiner

PROTECTION DEVICE FOR AN ELECTRICAL CIRCUIT, ELECTRICAL CIRCUIT EQUIPPED WITH SUCH A DEVICE AND METHOD FOR PROTECTING SUCH AN ELECTRICAL CIRCUIT

This application is a National Stage application of PCT International Application No. PCT/EP2019/082686, filed on Nov. 27, 2019 which claims the priority of French Patent Application No. 1872011, filed on Nov. 28, 2018, both of which are incorporated herein by reference in their entirety.

TECHNICAL FIELD

The present invention relates to a protection device for an electrical circuit, as well as an electrical circuit equipped with such a protection device. Finally, the invention relates to a method of protecting such an electrical circuit.

BACKGROUND

In the field of protection of an electrical circuit, it is known to use an electric protection device or component capable of opening the electrical circuit when the latter has an electrical fault current flowing through it, such as an overload current or a short-circuit current.

In this respect, several protective devices exist, such as fuses. A fuse is a dipole that uses the Joule effect of the electric current flowing through it to melt an electric conductor in case of overcurrent, thus opening the electrical circuit and preventing the electric current from flowing. Fuses are sized according to the intensity of the fault current that the system must protect, as well as its opening time. Pyrotechnic circuit breakers, also called pyroswitch, are also known.

However, the pyrotechnic circuit breaker requires a control circuit capable of providing the trip command. Such a control circuit may be complex and comprise, for example, a current sensor, a data processing unit and a microcontroller. Thus, the control circuit requires to be powered by an external power source. The protection device formed by the pyroelectric circuit breaker and its control circuit is not autonomous and generates a higher cost and space requirement, in particular because of the external power source.

It is to these disadvantages that the invention more particularly intends to remedy by proposing a new protection device for an electrical circuit which is autonomous, while reducing production costs.

SUMMARY

In this spirit, the invention relates to a protection device for an electrical circuit configured to transmit an electric current, the protection device comprising:

- a first conductor,
- a second conductor,
- at least one component for interrupting an electric current, the circuit breaker including a control zone, able to receive a tripping signal, and a power zone for passing the electric current, and
- a control circuit configured to produce and transmit the tripping signal to the control zone of the pyroelectric circuit breaker, the device further comprising a fuse connected in series between the first conductor and the circuit breaker so that the current flowing through the fuse passes entirely through the power zone of the circuit breaker when the power zone is in a state allowing the current to flow, the fuse being capable of supplying a supply voltage to the control circuit, and in that the control circuit is connected between the fuse and the control zone of the circuit breaker.

By means of the invention, the fuse provides information about the presence of an electrical fault current and the supply voltage necessary for the operation of the control circuit. The control circuit is responsible for producing and transmitting the trip signal to the circuit breaker. The protection device has a low production cost and a small footprint, as it does not require an external power supply for tripping the circuit breaker. The protection device thus allows the recovery of the electrical energy produced by the fuse melting. Moreover, the protection device according to the invention induces very low power losses and improved breaking performance.

According to advantageous but non-mandatory aspects of the invention, such a protection device comprises one or more of the following features, taken in any technically permissible combination:

- the trip current of the fuse is equal to a nominal value of the electrical current, this nominal value of the current being defined as the maximum value of the current intended to flow through the protection device in normal operation.
- the rated voltage of the fuse is at least four times lower than or equal to the nominal value of the electric voltage applied to the terminals of the protection device.
- the device is configured to be successively in a closing configuration where the fuse is not melted, a first intermediate configuration where the fuse is melted and the supply voltage is supplied to the control circuit, a second intermediate configuration where the circuit breaker is tripped, and an opening configuration where the fuse is melted.
- the device comprises at least two circuit breakers connected in parallel to the fuse between the first conductor and the second conductor, such that the current flowing through the fuse is entirely shared between the respective power zones of the at least two circuit breakers when these power zones are in a state allowing the passage of the current.
- the device comprises at least two circuit breakers connected in series between the first conductor and the second conductor, such that the current flowing through the fuse is also shared between the respective power zones of the at least two circuit breakers when these power zones are in a state allowing the current to flow.
- the control circuit comprises a potentiometer capable of controlling the tripping signal transmitted to the control zone of the circuit breaker.
- the device further comprises a diagnostic system comprising:
- a first sensor for measuring the current flowing in the control zone.
- a second sensor for measuring the current flowing in the power zone.
- an electronic processing unit programmed to compare the current values measured by the first sensor and the second sensor and to detect a failure of the protection device depending on the measured current values.

The invention also relates to an electrical circuit configured to be supplied with an electric current, the electrical circuit being equipped with a protective device according to the invention.

Finally, the invention relates to a method of protecting an electrical circuit according to the invention, the method comprising, at least, steps of:

a) melting of the fuse caused by an electric fault current and supply of the control circuit, the electric fault current flowing completely through the power zone.
b) transmitting the tripping signal to the circuit breaker by means of the control circuit,
c) tripping the circuit breaker and switching off the power zone of the circuit breaker.

According to a particular embodiment of the invention, in step a), the supply voltage to the control circuit is produced by an arc which is created across the fuse.

BRIEF DESCRIPTION OF THE DRAWINGS

The invention will be better understood, and other advantages thereof will become clearer in the light of the following description of a protection device, an electrical circuit, and a method in accordance with the invention, given only by way of a non-limiting example and made with reference to the appended drawings, in which:

In FIG. 1, there is shown an electrical circuit 1 configured to be supplied with an electrical current I and equipped with a protection device 2. The electrical circuit 1 comprises a load 3 and is intended to be connected to an unrepresented source of current, direct, or alternating, depending on the load 3. The protection device 2 is able to open the electrical circuit 1 when an electric fault current flows through the latter. An electric fault current is considered to be any electric current I having an intensity greater than or equal to a nominal current value $I_n$, also called nominal current $I_n$. This nominal current value $I_n$ is defined as being the maximum value of the current intended to flow in the protection device 2 in normal operation. It is predetermined depending on the nature of the electrical circuit 1. Thus, in the following description, the electric fault current is defined as the sum of $I_n+I_d$, where $I_d$ denotes an overcurrent. The maximum electric potential difference that can be applied between the terminals of the protection device 2 by supplying the load 3, without being cut off by the protection device 2, is named nominal voltage value and noted $V_n$ in what follows. This nominal voltage value is also determined depending on the nature of the electrical circuit. The choice of the nominal current value $I_n$ and the nominal voltage value $V_n$ depends on the nature of the load 3 to be protected.

Figure 1:
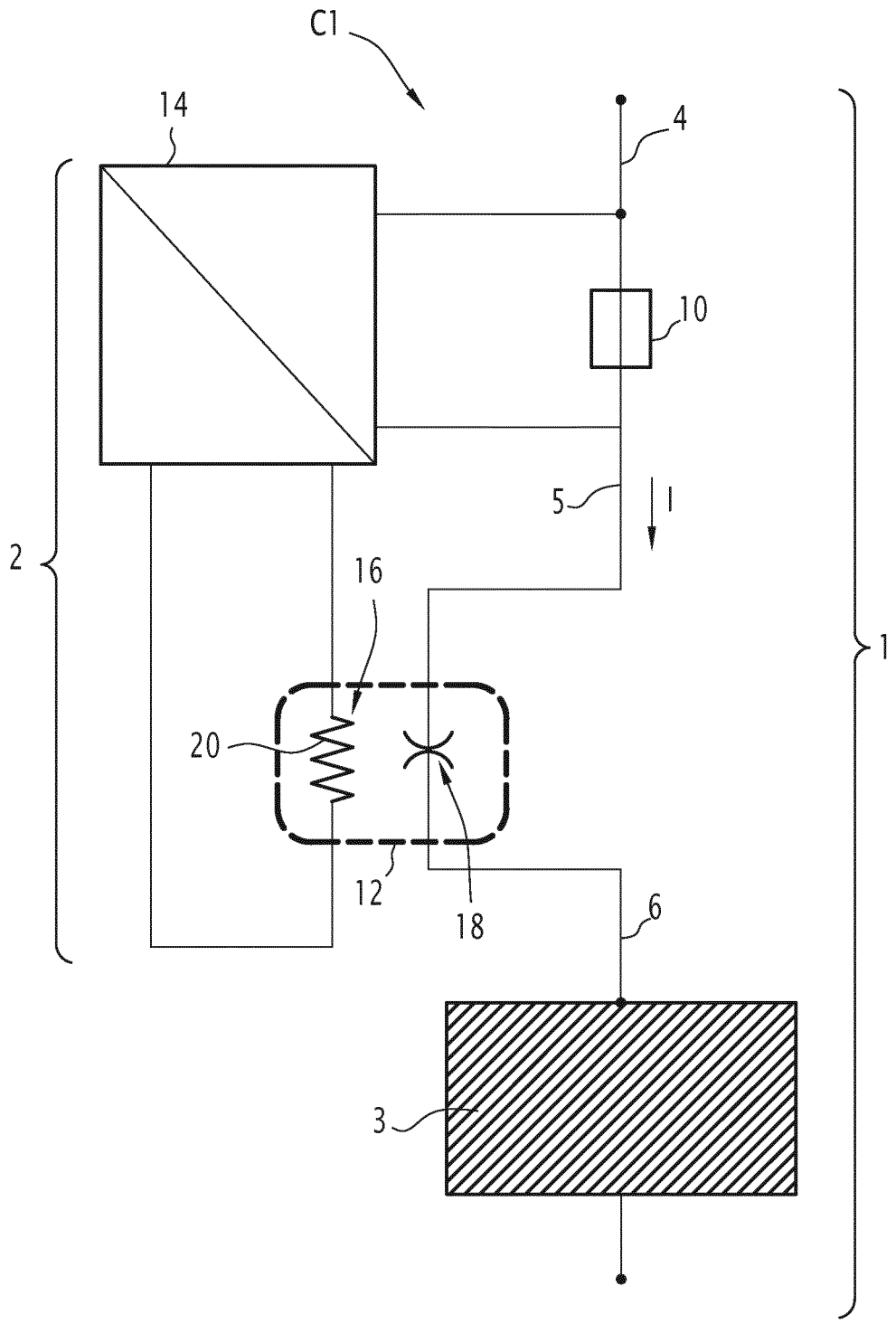
FIG. 1 is a schematic representation of a protection device according to the invention and of an electrical circuit comprising this protection device.

The electric fault current $I_d$ is, for example, an overload current or a short-circuit current and constitutes a risk for the load 3 of the electrical circuit 1. The protection device 2 comprises a first conductor 4 and a second conductor 6. In this example, the first conductor 4 forms an input conductor for the electric current, and the second conductor 6 forms an output conductor for the electric current. The load 3 is connected to the output conductor. The conductors 4 and 6 are configured to connect the protection device 2 to the rest of the electrical circuit 1 and thus for the passage of any electric current. In normal operation, i.e. in the absence of an electric fault current, the electric current I flowing between conductors 4 and 6 is less than or equal to the current rating $I_n$ and the electric voltage across conductors 4 and 6 is less than or equal to the voltage rating $V_n$.

The protection device 2 also comprises a fuse 10 electrically connected in series between conductors 4 and 6, as well as a circuit breaker 12 and a control circuit 14. The fuse 10 is connected in series between the input conductor 4 and the pyrotechnic circuit breaker 12. It should be noted that 5 is an intermediate conductor connecting the fuse 10 and the circuit breaker 12 to each other, which is thus interposed between the conductors 4 and 6.

In a manner known per se, a fuse is a dipole whose terminals are electrically connected to each other only by a conductive element which is able to be destroyed, generally by melting due to the Joule effect, when an electric current which exceeds a threshold value flows through it. This threshold value is called "tripping current". The rated voltage of a fuse is defined here as the electric voltage value at the fuse terminals above which the fuse cannot interrupt the current flow when the conducting element has been destroyed. When a fuse has begun to melt, if a voltage greater than this rated voltage is applied across its terminals, then an electric arc is formed across those terminals and remains there, allowing an electric current to flow.

In the following, a fuse is said to be "melted" when the conductive element has been destroyed and no electric arc can form given the values of the electric voltages present in the electrical circuit 1. It then forms an electrical open circuit through which no electric current can flow. A fuse is said to be "melting" when the electric current flowing through it has exceeded the rated current, causing the conductive element to begin to melt, but the electric voltage at its terminals is higher than the rated voltage of this fuse, causing an electric arc to appear between its terminals. The electric arc continues as long as the fuse is melting.

The tripping current $I_{10}$ of fuse 10 is equal, in practice to within 1% or 3%, to the nominal value $I_n$.

The rated voltage $V_{10}$ of fuse 10 is significantly lower than the nominal value $V_n$. By "significantly" is meant that the rated voltage is at least four times, for example five times or ten times lower than the nominal value $V_n$.

The circuit breaker 12 is a controllable electrical device configured to interrupt the flow of an electric current in response to a control signal.

The circuit breaker 12 comprises a first zone 16 and a second zone 18.

The first zone 16 is referred to as the control zone and is able to receive a tripping signal S. The second zone 18 is referred to as the power zone.

The power zone 18 is the part of the circuit breaker 12 electrically connected in parallel to the first fuse 8. It is configured for the passage of the electric current I that supplies the electrical circuit 1.

The fuse 10 is connected in series between the first conductor 4 and the circuit breaker 12 in such a way that the current I flowing through the fuse 10 passes entirely through the power zone 18 of the circuit breaker 12 when the power zone 18 is in a state allowing the current to flow.

In other words, no other element is here connected in series with the fuse 10 in parallel with the power zone 18, so that the current I cannot flow anywhere other than through the power zone 18.

Figure 2:
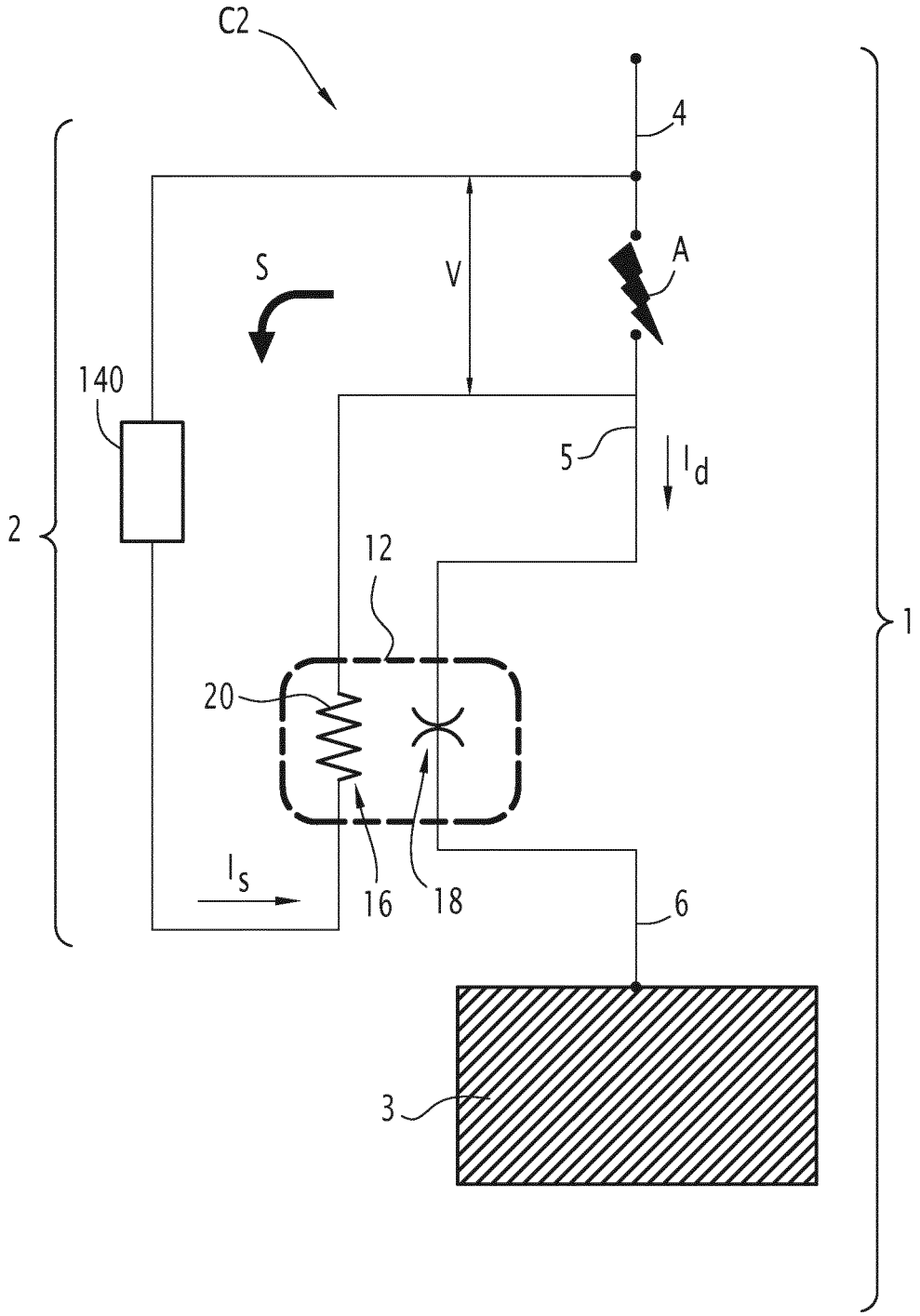
FIG. 2 is a schematic representation of the protection device in FIG. 1, when a fuse is melted.

In practice, in the event that an electric current, greater than the rated current $I_n$ flows through the protection device 2, the fuse 10 begins to melt and an electric arc A, as shown in FIG. 2, begins to appear between its terminals.

According to embodiments, more particularly described hereinafter as illustrative and not necessarily limiting examples, the circuit breaker 12 is a pyrotechnic circuit breaker 12.

However, alternatively, the circuit breaker 12 may be made differently and the description below is transposable to the more general case of any breaker.

For example, alternatively, the circuit breaker 12 is a switch such as a circuit breaker or a contactor. In this case, the power zone 18 corresponds to a cut-off zone with separable contacts, and the control zone 16 corresponds to a tripping mechanism capable of being controlled by an electric voltage to open the contacts of the power zone 18.

The control zone 16 of the pyroelectric circuit breaker 12 comprises a resistor 20 able to heat up when an electric current is passed through it. In a manner known per se, the pyroelectric circuit breaker also comprises an explosive agent, not shown, such as an explosive powder, and a cut-off element, such as a piston or a guillotine. The cut-off element, which is not shown, is made of an electrically insulating material, for example plastic. It is suitable for cutting the power zone 18. In practice, when an electric current flows through the resistor 20 of the control zone 16, the resistor 20 heats up and triggers the detonation of the explosive agent, which causes the cut-off element to switch from a first position where it is away from the power zone 18 to a second position where it cuts off the power zone 18 so as to interrupt the passage of electric current in the electrical circuit 1.

The control circuit 14 is configured to produce and transmit the tripping signal S to the control zone 16 of the pyroelectric circuit breaker 12. The control circuit 14 is connected between the fuse 10 and the control zone 16. In practice, the tripping signal S produced by the control circuit 14 is an electric tripping current $I_s$ that is transmitted to the control zone 16. Thus, the tripping current $I_s$ flows through the resistor 20 and trips the pyroelectric circuit breaker 12.

In a manner known per se, the control circuit 14 may comprise one or more active and/or passive electrical components for producing and transmitting the tripping signal S. In particular, the control circuit 14 does not include an internal power source.

According to an embodiment not shown in the figures, the control circuit 14 comprises a potentiometer capable of controlling the tripping current $I_s$ transmitted to the pyroelectric circuit breaker 12. In practice, the potentiometer is configured to modulate the intensity of the electric current $I_s$ that is supplied to the control zone of the pyroelectric circuit breaker 12. Thus, the potentiometer of the control circuit 14 is configured to control the opening speed of the pyroelectric circuit breaker 12.

Thus, the protective device 2 is configured to be in different configurations C1, C2, and C3, namely a closing configuration C1, a first intermediate configuration C2, and an opening configuration C3.

In the closing configuration C1 shown in FIG. 1, the electric current I supplying the electrical circuit 1 is lower than the nominal current $I_n$ and therefore the fuse 10 does not melt.

In the intermediate configuration C2 shown in FIG. 2, the electric current I supplying the electrical circuit 1 is higher than the threshold value $I_n$. The fuse 10 then starts to melt, and the electric arc A appears between its terminals. This electric arc A causes the appearance of an electric supply voltage V, which is then supplied to the control circuit 14. Indeed, the rated voltage V10 of the fuse 10 is chosen so that the electric arc A remains present between its terminals while it is melting, as long as the current I flows.

Figure 3:
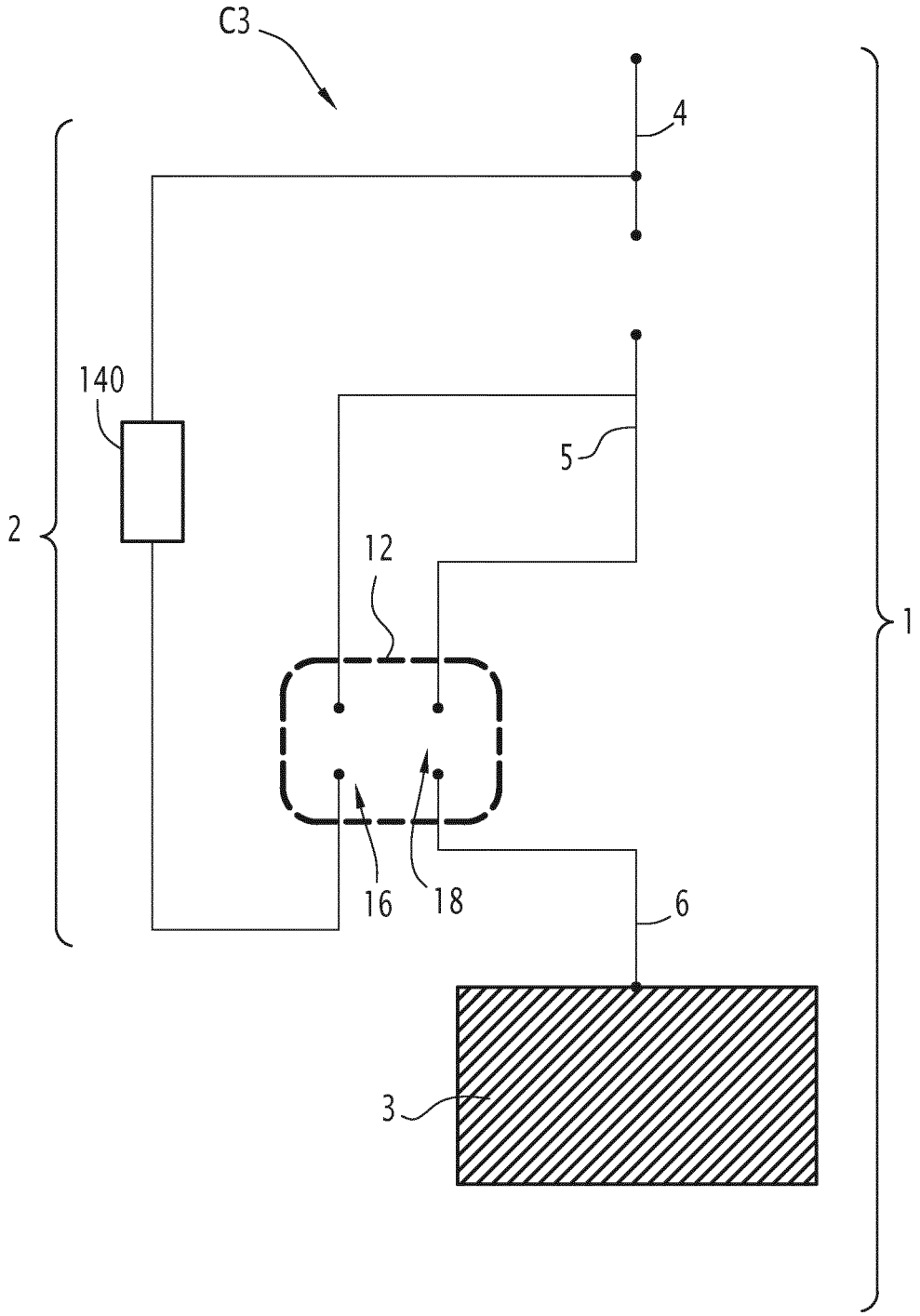
FIG. 3 is a similar representation to FIG. 2, when the circuit breaker is open.
Figure 4:
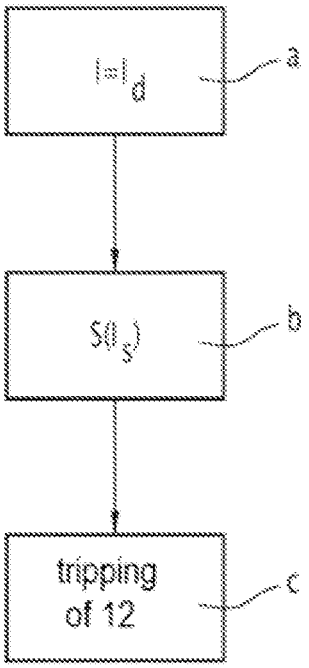
FIG. 4 is a block diagram of a protection method according to the invention.

In the opening configuration C3 shown in FIG. 3, the pyroelectric circuit breaker 12 is tripped. The control circuit 14, supplied with the voltage V, produces the tripping signal S from this voltage V and transmits it, in the form of the current $I_s$, to the electric resistor 20 of the control zone 16, tripping the pyroelectric circuit breaker 12, which rapidly opens the power zone 18.

In FIG. 1, the control circuit 14 is shown as a "box" connected between the fuse 10 and the control zone 16. In FIGS. 2 and 3, the control circuit 14 is shown as an electrical resistor 140, for the reasons discussed below. The electrical resistor 140 is subjected to the supply voltage V generated across the fuse 10. Here, the value of the resistor 20 is less than ten times or one hundred times the value of the resistor 140. It is therefore the value of the resistor 140 that determines the value of the current $I_s$ transmitted to the control zone 16. Indeed, regardless of the electrical components of the control circuit 14, the control circuit 14 can be represented electrically by a simple resistor 140 in an electrical diagram, as is the case in FIGS. 2 and 3. In the schematics of FIGS. 2 and 3, the electrical resistor 140 is electrically connected in series with the electrical resistor 20. The assembly formed by the resistor 20 and the resistor 140 is electrically connected in parallel with the fuse.

A method of protecting the electrical circuit 1, equipped with the protective device 2, is implemented when an electric current I greater than the rated current $I_n$ occurs in the electrical circuit 1 and flows through the protective device 2. In this case, the overcurrent $I_d$ is strictly greater than zero. By default, the protection device 2 is in the closing configuration C1 since the electric current I feeds the electrical circuit 1 and the fuse 10 does not melt. The protection method is described below.

At the beginning of this method, and in an initial step a), a fault occurs in the supply to the electrical circuit 1 and the electric current flows through the protection device 2. Due to the electric current, and within a time interval predetermined by the rating of the fuse 10, the fuse 10 begins to melt and the electric arc A is established across the terminals of the fuse 10. As mentioned above, the fuse 10 is sized so that the electric arc A remains present between the terminals while it is melting, as long as the current I is present, which generates the supply voltage V and ensures the current flow. This voltage V is used to supply the control circuit 14. At the end of step a), the protection device 2 is in its first intermediate configuration C2 where the fuse 10 is melting and the supply voltage V is supplied to the control circuit 14. As mentioned above, since the control circuit 14 is a passive circuit, the supply voltage V provided by the fuse 10 represents the only source of power to the control circuit 14 required for the operation of the control circuit 14. Thus, in step a), the method involves the melting of the fuse 10 caused by the electric current I being greater than $I_n$ and the supply of the control circuit 14. During this step a), the electric fault current flows entirely through the power zone 18, since no other elements are here connected in series with the fuse 10 in parallel with the power zone 18, as explained above.

The method then comprises a step b) in which the control circuit 14 produces the tripping signal S, which corresponds to the tripping electric current $I_s$. Subsequently, the control circuit 14 transmits this tripping current $I_s$ to the pyroelectric circuit breaker 12, in particular to the control zone 16 of the pyroelectric circuit breaker 12. Since the electric arc A is still present across the fuse 10, the electric fault current $I_d$ still flows through the power zone 18 of the pyroelectric circuit breaker 12. In step b), the method comprises transmitting the tripping signal S to the pyroelectric circuit breaker 12 by means of the control circuit 14.

Subsequently, the method comprises a step c) which comprises tripping the pyroelectric circuit breaker 12 and switching off the power zone 18 of the pyroelectric circuit breaker 12. In practice, the electric current $I_s$ flows through the electric resistor 20 of the power zone 16, which heats up and triggers the detonation of the explosive agent of the pyroelectric circuit breaker 12. As explained above, the detonation of the explosive agent causes the switch element to flip from its first position to its second position so as to cut off the power zone 18 of the pyroelectric circuit breaker 12. At the end of step c), the protective device 2 is in its opening configuration C3 where the pyroelectric circuit breaker 12 is tripped, the power zone 18 is open.

In the above examples due to the fact that no element, in particular no second fuse, is connected in parallel with the power zone 18 and in series with the fuse 10, then the reliability of the protection device 2 is improved since there is no risk that this element, in particular this second fuse, will suffer a failure that could compromise the proper functioning of the protection device 2. In addition, the number of parts is reduced, which facilitates the construction of the protection device 2.

Figure 5:
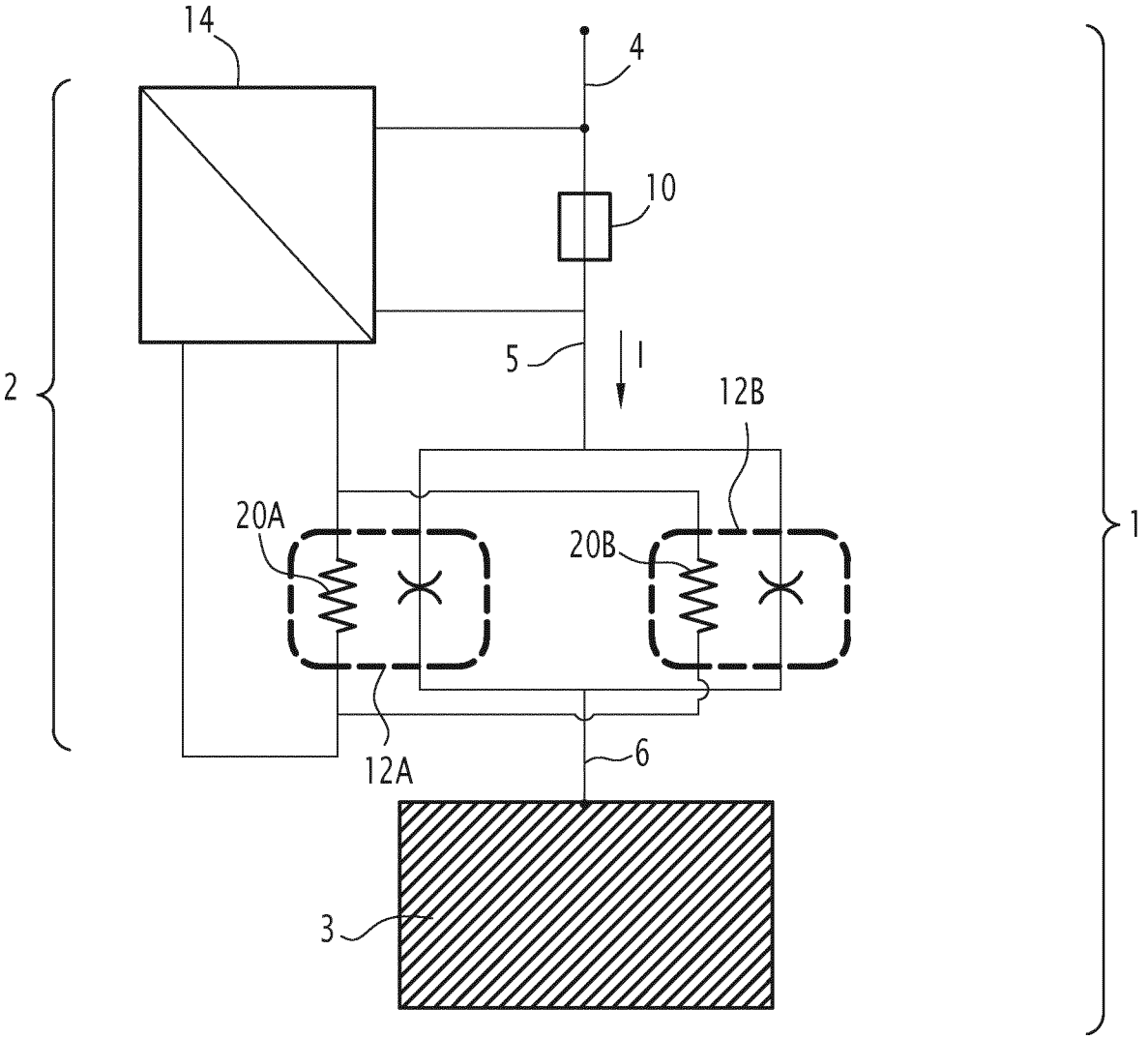
FIG. 5 is a representation similar to FIG. 1, for a protection device and circuit according to a second embodiment of the invention.

FIG. 5 shows a second embodiment of the invention. The elements of the protective device 2 of this embodiment which are similar to those of the first embodiment bear the same references and are not described in detail insofar as the above description can be transposed to them.

The protection device 2 according to this second embodiment comprises two circuit breakers 12A and 12B. The two circuit breakers 12A and 12B are connected in parallel between the input conductor 4 and the output conductor 6 in such a way that the current I flowing through the fuse 10 is entirely shared between the respective power zones 18 of the at least two circuit breakers 12A, 12B when these power zones 18 are in a state allowing the current to flow. In other words, no other elements are here connected in series with the fuse 10 in parallel with the power zones 18, so that the current I cannot flow anywhere other than through the respective power zones 18 of the at least two circuit breakers 12A and 12B.

By way of example, the circuit breakers 12A and 12B are pyroelectric circuit breakers 12A and 12B here. In particular, each pyroelectric circuit breaker 12A and 12B comprises an electric resistor 20A and 20B. The electric resistors 20A and 20B are in parallel and thus have a portion of the tripping electric current $I_s$, flowing through them, which causes these resistors 20A and 20B to heat up, as explained above.

According to an alternative embodiment not shown in the figures, the protection device 2 comprises three or more circuit breakers connected in parallel, such that the current I flowing through the fuse 10 is entirely shared between the respective power zones 18 of the said circuit breakers 12A, 12B when these power zones 18 are in a state allowing current flow.

The introduction of a plurality of pyroelectric circuit breakers connected in parallel allows the protection device 2 to cut off an electric current I having a very high intensity. For example, for the variant shown in FIG. 5, each pyroelectric circuit breaker 12A and 12B is configured to cut off an electrical fault current $I_d$ having an intensity of 200 amperes. Thus, the protective device 2 is capable of interrupting an electric current I having a total current of 400 amperes.

Figure 8:
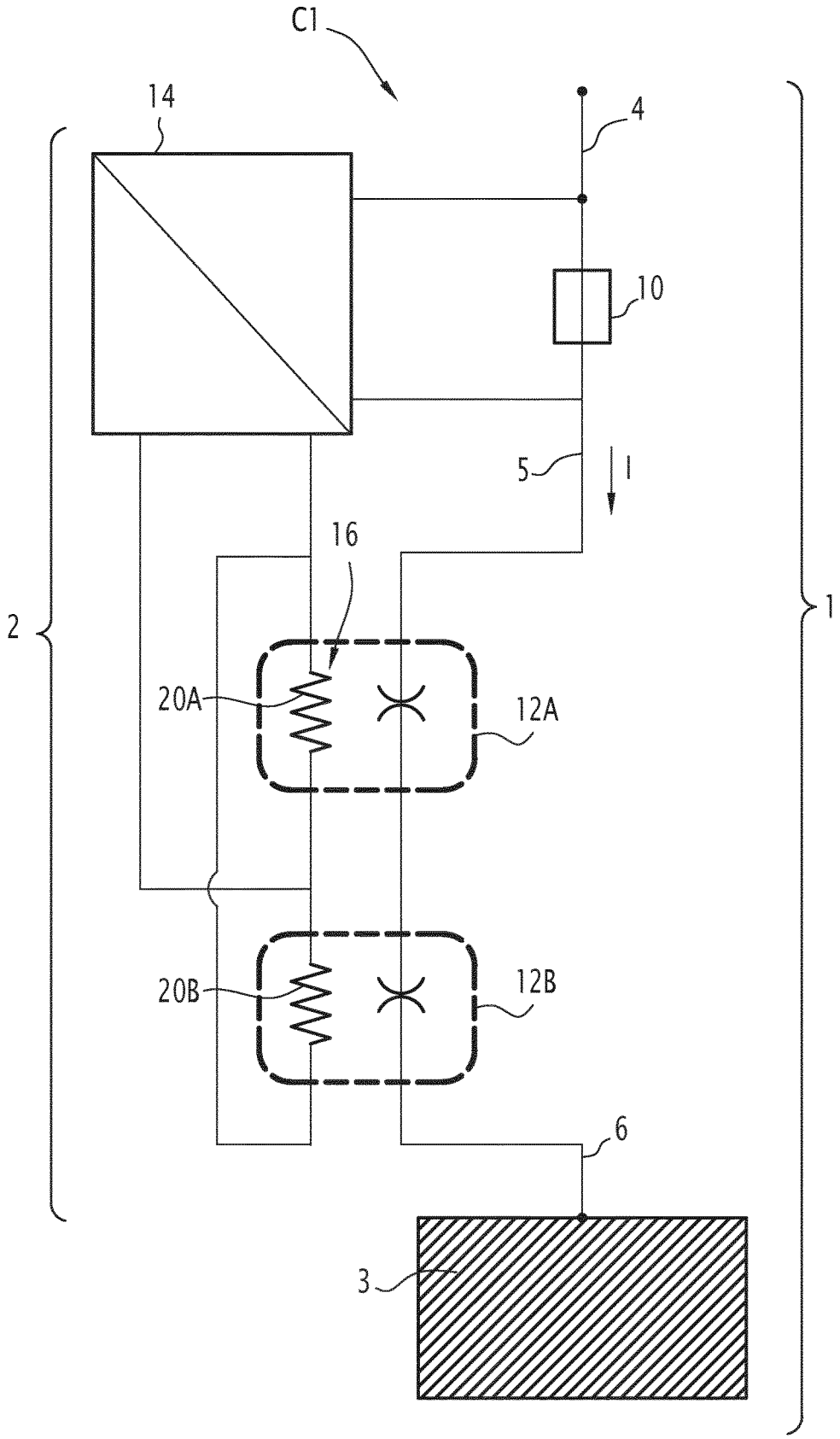
FIG. 8 is a representation similar to FIG. 1, for a protection device and a circuit according to another embodiment of the invention.

FIG. 8 shows another embodiment of the invention. The elements of the protective device 2 of this embodiment which are similar to those of the above-described embodiments bear the same references and are not described in detail to the extent that the above description can be transposed to them.

The protection device 2 according to this alternative embodiment comprises two circuit breakers 12A and 12B. The two circuit breakers 12A and 12B are connected in series between the input conductor 4 and the output conductor 6 such that the current I flowing through the fuse 10 also flows through the respective power zones 18 of the at least two circuit breakers 12A, 12B when these power zones 18 are in a state permitting current flow. In other words, no other elements are here connected in series with the fuse 10 in parallel with the power areas 18, so that the current I cannot flow anywhere other than through the respective power areas 18 of the at least two circuit breakers 12A and 12B.

By way of example, the circuit breakers 12A and 12B are pyroelectric circuit breakers 12A and 12B here. In particular, each pyroelectric circuit breaker 12A and 12B comprises an electric resistor 20A and 20B. The electric resistors 20A and 20B are in parallel and thus have a portion of the tripping electric current $I_s$ flowing through them, which causes these resistors 20A and 20B to heat up, as explained above.

According to a variant not shown in the figures, the protection device 2 comprises three or more circuit breakers connected in series, such that the current I flowing through the fuse 10 also flows through the respective power zones 18 of the said circuit breakers 12A, 12B when these power zones 18 are in a state allowing current flow.

The introduction of a plurality of pyroelectric circuit breakers connected in series enables the protection device 2 to cut off an electric voltage U having a very high voltage. For example, for the variant shown in FIG. 8, each pyroelectric circuit breaker 12A and 12B is configured to cut off an electric voltage $U_n$ having a voltage of 500 volts. Thus, the protection device 2 is able to cut off an electric voltage U having a total voltage of 1000 volts. Alternatively, the load 3 is electrically connected to the first conductor 4. The electric current 1 then flows from the second conductor 6 towards the first conductor 4 in normal operation.

Figure 6:
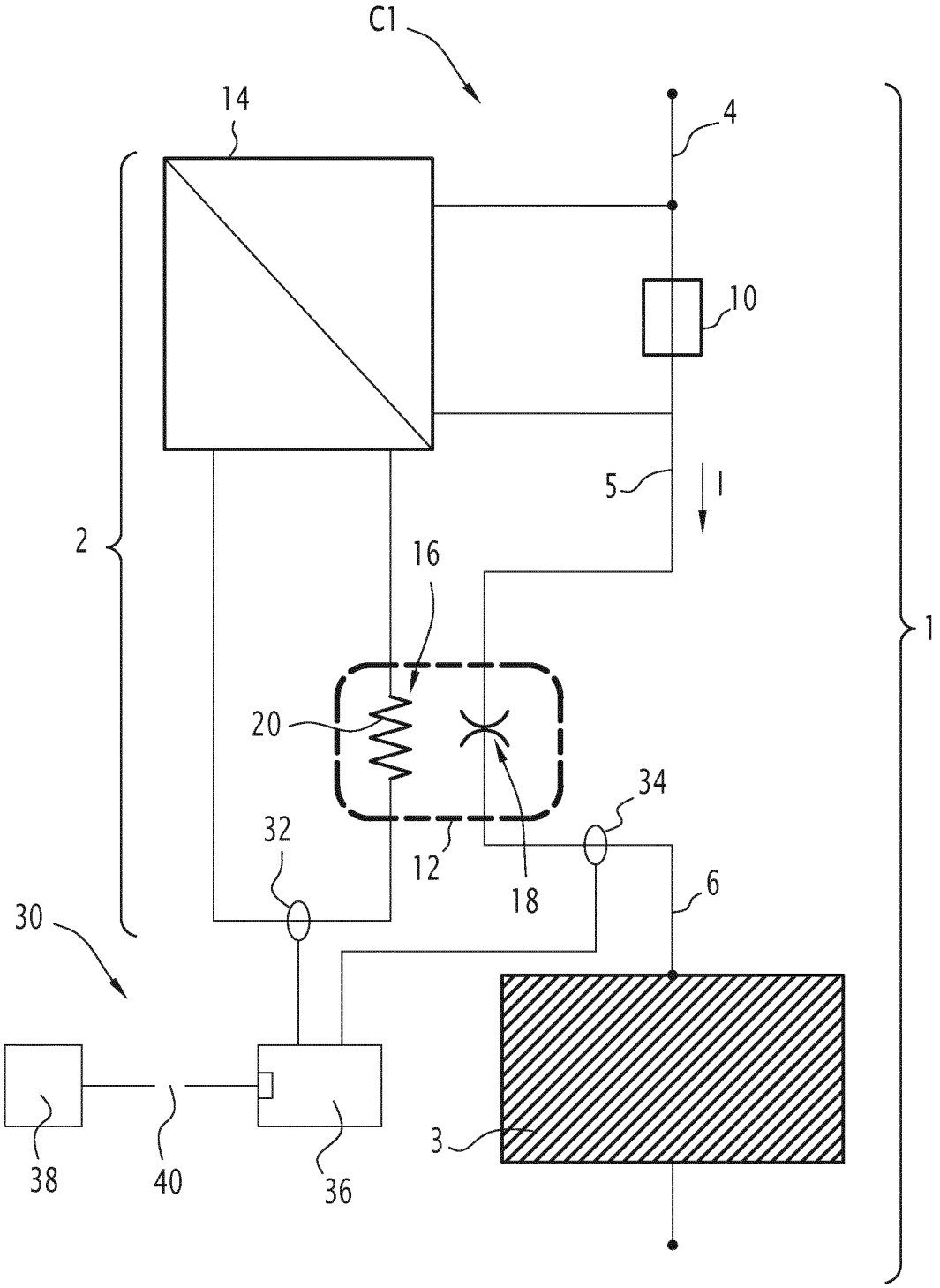
FIG. 6 is a schematic representation of a protection device and an electrical circuit comprising this protection device, according to a third embodiment of the invention.
Figure 7:
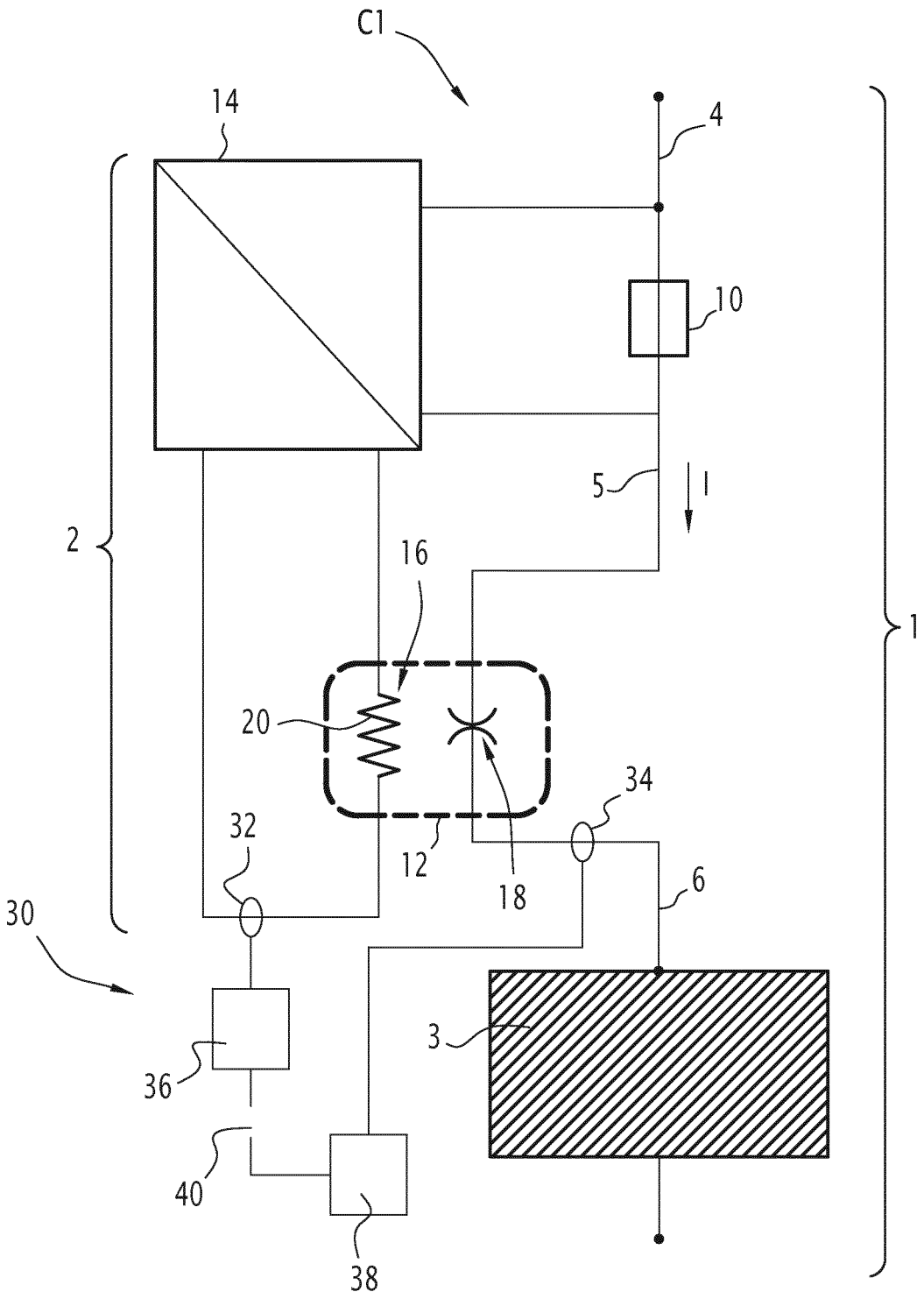
FIG. 7 is a schematic representation of a protection device and an electrical circuit comprising this protection device, according to a fourth embodiment of the invention.

FIGS. 6 and 7 illustrate two further embodiments of the invention. The elements of the protective device 2 according to these two embodiments which are similar to those of the previously described embodiments bear the same references and are not described in detail, inasmuch as the above description can be transposed to them.

According to these other embodiments, the device 2 further comprises a diagnostic system 30 comprising a first sensor 32 for measuring the current $I_s$ flowing in the control zone 16, a second sensor 34 for measuring the current I flowing in the power zone 18 and an electronic processing unit programmed to compare the current values measured by the first sensor 32 and the second sensor 34 and to detect a failure of the protection device 2 based on the measured current values.

The diagnostic system 30 is used to detect the occurrence of a failure that may affect the proper operation of the protection device 2, such as the failure of the control zone 16, a failure of the fuse 10 or the accidental breakage of one of the connectors.

In practice, in the absence of a failure of the protection device 2, the value of the current $I_s$ measured by the first sensor 32 is related to the value of the current I measured by the second sensor 34. For example, these two current values I and $I_s$ are linked by a proportionality relationship that is a function of the temperature of the protection device 2.

For example, a failure is considered to be present in the protection device 2 if the current value $I_s$ measured by the first sensor 32 is zero while the current value I measured by the second sensor 34 is not zero.

According to example implementations, the diagnostic system comprises a first electronic processing unit 36 that is connected to a remote second electronic processing unit 38 via a data link 40.

The second processing unit 38 is configured, for example, to, upon receiving a signal indicating a failure, initiate measures to make the circuit 1 safe, such as disconnecting the electric source supplying the circuit 1 or disconnecting the electric load 3, for example by means of a contactor or a breaker, not shown.

According to a first example, as illustrated in FIG. 6, the first sensor 32 and the second sensor 34 are both connected to the first processing unit 36. The comparison and detection of a failure is performed by the first processing unit 36. The first processing unit 36 is further programmed to send a fault detection signal to the second processing unit 38 via the data link 40.

According to a second example, as illustrated in FIG. 7, the first sensor 32 is connected to the first processing unit 36. The second sensor 34 is connected to the second processing unit 38. The comparison and detection of a failure is performed by the second processing unit 36. The first processing unit 36 is further programmed to transmit the current value measured by the current sensor to which it is connected to the second processing unit 38 via the bus 40.

Preferably, the sensors 32 and/or 34 are current sensors. For example, the current sensors 32 and/or 34 are Hall effect sensors or inductive sensors or current transformers.

Alternatively, the sensors 32 and/or 34 include a voltage sensor that measures the electric voltage across a resistor.

According to yet another variant, the sensors 32 and/or 34 include a current injection device including a coil surrounding the branch of the circuit wherein the current to be measured flows, the device being able to inject into the branch, by means of the coil, an electric current presenting a predefined form (e.g. a pulse or a sinusoidal signal). The device comprises a second coil surrounding the said branch and allowing to measure the total current flowing in the said branch, and a processing circuit allows to automatically determine the value and/or the signal shape of the current to be measured flowing in the said branch.

According to variants not illustrated, the measurement of the current I by the system 30 is performed indirectly, by measuring the electrical properties of the load 3. Thus, the second sensor 34 is not associated with an electrical conductor of the circuit 1 but, instead, is associated with the load 3. The second sensor 34 is then not necessarily a current sensor.

The processing units 36 and 38 comprise for example a dedicated electronic circuit and/or a programmable microcontroller.

The data link 40 is a wired link, for example a field bus such as a CAN bus or a LIN bus, or a wireless link.

According to variants not shown, a diagnostic system similar to the diagnostic system 30 may be used in embodiments of the protection device 2 comprising a plurality of circuit breakers 12, for example in the embodiments of the protection device 2 shown in FIGS. 5 and 8.

According to variants, in order to gain compactness, the various components of the diagnostic system 30 may be integrated in a single housing.

According to examples, at least some of the components of the diagnostic system 30 may be integrated in the same electronic element, such as an ASIC-type integrated circuit.

According to other aspects, the diagnostic system 30 according to any of the embodiments presented above may comprise a temperature sensor, preferably installed in the vicinity of or in contact with the device 2. In this case, the electronic processing unit is programmed to correct the current measurements provided by the or each sensor 32 and/or 34 depending on the measured temperature.

The variants contemplated above may be combined with each other to generate new embodiments of the invention.

The invention claimed is:

1. A protection device for an electrical circuit configured to transmit an electric current, the protection device comprising:

a first conductor, a second conductor, at least one circuit breaker for interrupting an electric current, the circuit breaker comprising a control zone, capable of receiving a tripping signal, and a power zone for passing the electric current, a control circuit configured to produce and transmit the tripping signal (S) to the control area of the circuit breaker, and a diagnostic system comprising:

a first sensor for measuring a current flowing in the control zone, a second sensor for measuring a current flowing in the power zone; and an electronic processing unit programmed to compare the current values measured by the first sensor and the second sensor and to detect a failure of the protection device according to the measured current values, wherein the device further comprises a fuse connected in series between the first conductor and the circuit breaker in such a way that a current flowing through the fuse passes entirely through the power zone of the circuit breaker when the power zone is in a state allowing the passage of the current, the fuse being capable of supplying a supply voltage to the control circuit, and wherein the control circuit is connected between the fuse and the control zone of the circuit breaker.

2. The device according to claim 1, wherein the tripping current of the fuse is equal to a nominal electric current value, this nominal current value being defined as the maximum value of the current intended to flow in the device during normal operation.

3. The device according to claim 2, wherein the rated voltage of the fuse is at least four times lower than or equal to the nominal value of electric voltage.

4. The device according to claim 1, wherein the device is configured to be successively in:

a closing configuration where the fuse is not melted, a first intermediate configuration where the fuse is melting, and the supply voltage is supplied to the control circuit, an opening configuration where the circuit breaker is tripped.

5. The device according to claim 1, wherein the device comprises at least two circuit breakers connected in parallel between the first conductor and the second conductor, such that the current flowing through the fuse is entirely shared between the respective power zones of the at least two circuit breakers when these power zones are in a state allowing the passage of current.

6. The device according to claim 1, wherein the device comprises at least two circuit breakers connected in series between the first conductor and the second conductor, so that the current flowing through the fuse also flows in the respective power zones of the at least two circuit breakers when these power zones are in a state allowing the passage of current.

7. The device according to claim 1, wherein the control circuit comprises a potentiometer able to control the tripping signal transmitted to the control zone of the circuit breaker.

8. An electrical circuit configured to be supplied with an electric current, the electrical circuit being equipped with a protection device according to claim 1.

9. A method of protecting an electrical circuit according to claim 8, the method comprising, at least:

a) melting the fuse caused by an electric fault current and supplying the control circuit, the electric fault current flowing completely through the power zone, b) transmitting by means of the control circuit, the tripping signal to the circuit breaker, c) tripping of the circuit breaker and disconnection of the power zone of the circuit breaker.

10. The method according to claim 9, wherein in step a) the supply voltage of the control circuit is generated by an electric arc which appears across the terminals of the fuse.

* * * * *